US009205343B1

(12) United States Patent
Wisniewski

(10) Patent No.: US 9,205,343 B1
(45) Date of Patent: Dec. 8, 2015

(54) PROGRAMMABLE TRACK MUSICAL TOY

(71) Applicant: John Wisniewski, Wauwatosa, WI (US)

(72) Inventor: John Wisniewski, Wauwatosa, WI (US)

( * ) Notice: Subject to any disclaimer, the term of this patent is extended or adjusted under 35 U.S.C. 154(b) by 57 days.

(21) Appl. No.: 14/205,932

(22) Filed: Mar. 12, 2014

(51) Int. Cl.
*A63H 19/14* (2006.01)
*A63H 19/02* (2006.01)

(52) U.S. Cl.
CPC ..... *A63H 19/02* (2013.01)

(58) Field of Classification Search
USPC ..... 446/397, 404, 408, 409, 410, 441, 442, 446/444, 447, 463, 467; 434/230; 84/402–405
See application file for complete search history.

(56) References Cited

U.S. PATENT DOCUMENTS 3,433,110 A * 3/1969 Stanton ..... 84/102
3,448,649 A * 6/1969 Tobari ..... 84/102
3,453,921 A * 7/1969 Hubiak et al. ..... 84/102
3,532,022 A * 10/1970 Genin ..... 84/102
3,590,679 A * 7/1971 Law ..... 84/102
5,127,869 A * 7/1992 Hanzawa ..... 446/397
5,391,078 A * 2/1995 Murphy ..... 434/113
5,816,886 A * 10/1998 Cusolito ..... 446/444
6,066,025 A * 5/2000 Wisniewski ..... 446/410
6,443,796 B1 * 9/2002 Shackelford ..... 446/91

* cited by examiner

*Primary Examiner* — Kurt Fernstrom

(57) ABSTRACT

A musical toy includes a vehicle traveling on a track which includes visual indicia representative of a standard nine note musical staff. Note tiles having first fastener halves may engage with second fasteners at predetermined locations on the track corresponding with the locations of notes on the represented staff. Switch operators facing down from the train may sense the note tiles to play the music so represented by the note tiles and track arranged in the staff and note configuration. The note tiles and track fastener features could be constructed in a format similar to the familiar stud and tube blocks of the popular Lego® system. An additional row of fastener halves could reside on the track adjacent to the main musical staff or outside the rails to allow for placement of tiles that could trigger sharp or flat notes, standard chords or perhaps percussive beat patterns. Also a cap placed on the top of the note blocks could trigger a distinct signal that could change the output to produce sharps, flats, a shift to a higher or lower octave or similar effects.

14 Claims, 7 Drawing Sheets

Fig. 4a
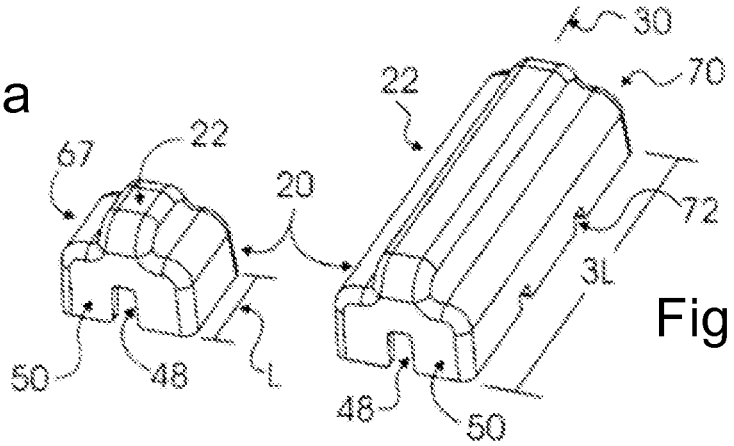
Fig. 4b
Fig. 5
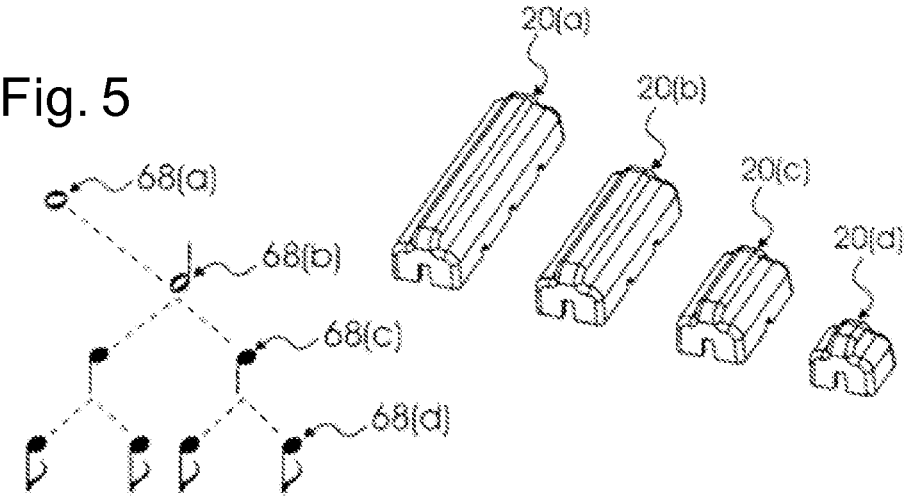
Fig. 6
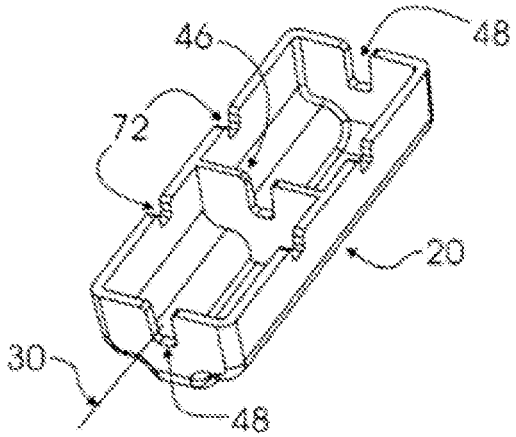

PROGRAMMABLE TRACK MUSICAL TOY

CROSS-REFERENCE TO RELATED APPLICATIONS

This application claims of the benefit U.S. provisional application No. 61/785,689 filed Mar. 14, 2013 entitled Programmable Track Musical Toy and hereby incorporated by reference.

BACKGROUND OF THE INVENTION

The present invention relates to musical toys and in particular to a musical vehicle that runs on a track representing the standard musical staff on which note tiles may be placed to be played by the vehicle.

Toy trains that play music when they run are well known in the art. Spring or battery powered trains including a music box or the like play a tune as they move across a track or a floor. Different tunes may be played by replacing a portion of the music box such as the disk or drum holding pins which engage a sound producing mechanism. Such trains provide limited play value insofar as the songs are either fixed or selected from a fairly narrow repertoire.

In order to increase the toy play value, an alternative design may be adopted which allows the child to compose his or her own music that the train may play as it moves along. U.S. Pat. No. 3,590,679, for example, describes one such train in which the ties of a railroad type track are xylophone bars which may be struck by the train as it travels along the track. The ties are replaceable so that by proper selection and sequencing of the ties, an arbitrary melody may be played. Nevertheless, the number of tunes that may be played with this device is severely limited for practical implementations by the number of ties that can be provided. For example for a simple eight note melody, sixty-four different tone bars would be required to allow complete compositional flexibility even constrained to a single octave. Typically, a child will find that one or more notes required for the melody has been exhausted.

Also, the xylophone-type train, while allowing greater creative input by the child, uses compositional metaphor (ties on a track) that is foreign to conventional musical notation, thus failing to take advantage of a valuable educational opportunity for early musical training.

A more coherent version of the musical metaphor is provided in U.S. Pat. No. 6,066,025 wherein the relationship of the musical staff and the notes on the track are referenced. Still, the visual analog of the musical staff therein remains vague, and the beats per note are not readily apparent to the user in the layout of the design. The devise as described does not account for the inclusion of sharp and flat notes or a means to play notes in a higher or lower octave.

Additionally, in the aforementioned U.S. Pat. No. 6,066,025 the attachment means of the note tiles does not provide a secure snap fit means. Thus, the smallest note tile must be sufficiently large to provide reliable stability to the system when engaging the levers on the vehicle so as to remain upright. This yields a track that is restrictively long for a child's toy. Particularly when a single line of musical track without curved connecting tracks is preferred to reduce cost and/or space requirements.

What is needed is a toy that provides the groundwork for early exposure to musical composition by providing a clear visual representation of the musical staff and having features that allow for playing a wider variety of note types and scales in a system that is compact in size with a secure connection method that is familiar to children.

BRIEF SUMMARY OF THE INVENTION

The present invention provides a toy vehicle and track, the latter depicting the five lines and four spaces of a standard musical staff Detachable note tiles may be snapped into different transverse positions onto the surface of the track approximating the position of notes on the staff and having different lengths to represent different note durations. The train traveling along the track plays notes according to the position of the note tiles and their length in the direction that the train travels.

Specifically, the present invention provides a musical toy having a vehicle having a carriage supported by wheels and holding a musical instrument having a plurality of transversely arrayed operators actuable to produce corresponding musical notes, the musical instrument held by the carriage of the vehicle to expose the operators therebelow. A plurality of note tiles have an upper surface for activating the operators and a lower surface having a first fastener half and fit against a track having longitudinally extending guides so the vehicle may move along the track in a longitudinal direction as oriented by the guides. The track further has a plurality of second fastener halves to releasably receive the first fastener halves of the note tiles in engagement at different transverse locations so that the upper surface of the note tiles may actuate the operators of the musical instrument when the vehicle passes over the engaged note tiles. The second fastener half comprises upwardly extending cylindrical studs arranged in rectilinear longitudinal rows and transverse columns and the first fastener half comprises a socket deforming to receive the cylindrical studs.

It is thus a feature of at least one embodiment of the invention to provide a more robust attachment method for the note tiles that provides compatibility with popular building sets.

The note tiles may be attached to posts on the track in a the familiar stud and tube method that construction toys such as Lego® utilize.

It is thus a feature of the invention to provide a simple, yet rigid means of attachment that is familiar to children.

The musical toy may further include a printed diagram depicting the track and note tiles adjacent to a parallel musical staff and notes, where the note tiles are aligned with the notes and wherein the note tiles are arranged on the track to play a song depicted by the musical staff and notes. The rows of studs may correspond in number to lines and spaces of a standard musical staff, for example equaling nine. In addition or alternatively, alternate longitudinal rows of cylindrical studs may be colored in a darker color than the intervening rows of longitudinal studs to depict staff lines.

It is thus a feature of at least one embodiment of the invention to provide a toy whose track provides a visual analog to the conventional musical staff to help teach musical concepts.

A longitudinal outer extent of the tiles may provide a feature such as a notch and the operator may sense the feature to modulate a note. The modulation may for example add tremolo, vibrato, or rhythmic beats to the note.

It is thus an object of at least one embodiment of the invention to provide additional dimension of musical control while preserving the basic staff form of the track.

The musical instrument may include capping elements having a lower surface releasably attaching to an upper surface of the note tiles having an upper surface for activating the operators to change a note played by the musical instrument with respect to that played by the note tile without the capping element. The capping elements may make the note flat or sharp, move it up or down an octave, or change the instrument or timbre of the note.

It is thus a feature of at least one embodiment of the invention to permit advanced musical concepts to be incorporated into the toy as a child's musical knowledge advances.

The foregoing and other objects and advantages of the invention will appear from the following description. In the description, reference is made to the accompanying drawings which form a part hereof and in which there is shown by way of illustration a preferred embodiment of the invention. Such embodiment does not necessarily represent the full scope of the invention, however, and reference must be made to the claims herein for interpreting the scope of the invention.

BRIEF DESCRIPTION OF THE SEVERAL VIEWS OF THE DRAWINGS

FIGS. 4*a* and 4*b* are perspective representations of two note tiles for half and quarter notes, respectively, showing the actuator elements on top of the note tiles and engaging notches receiving note ridges and measure ridges of the track;

FIG. 5 is a pictorial representation of the relationship between note tile lengths and notes used in standard musical notation and showing indicia placed on the note tiles to reflect this correspondence;

FIG. 6 is a figure of the underside of the half note tile of FIG. 4 showing internal structure and grooves for accepting note and measure ridges of the track;

DETAILED DESCRIPTION OF THE INVENTION

Background Design

Figure 1:
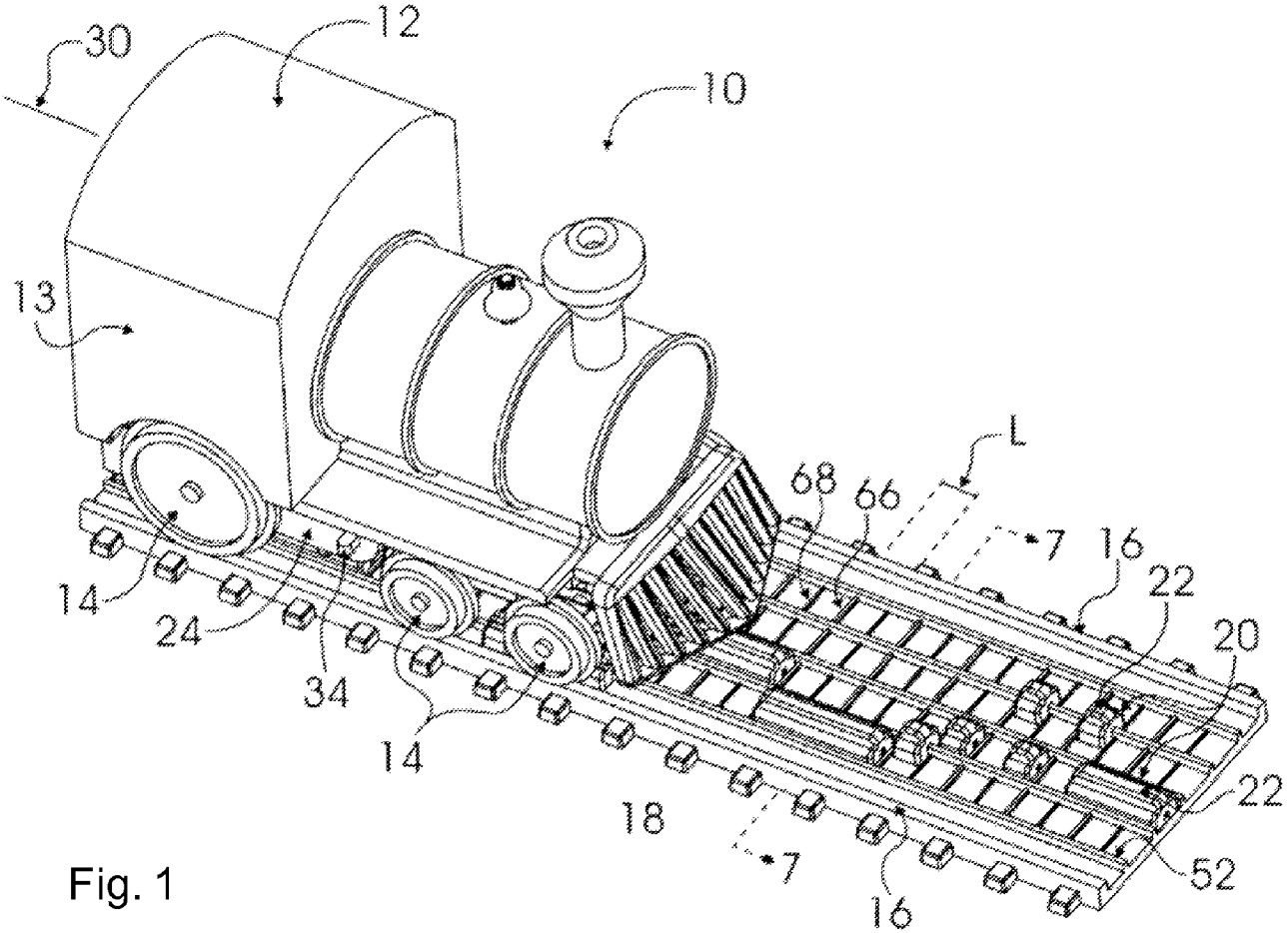
FIG. 1 is a perspective view of the toy of the present invention including a housing representing a train engine and incorporating a musical instrument held on a chassis, and further showing a track on which the chassis may ride, the track providing indicia representing a standard musical staff of one octave having various note tiles placed thereon.

Referring now to FIG. 1, a musical toy 10 of the present invention includes a vehicle, in this case a train 12, having flanged wheels 14 engaging upwardly extending outer rails 16 of a track 18 to move thereon in a longitudinal direction 30. Placed at various locations on the upper surface of the track 18 are note tiles 20 having upwardly extending actuator ridges 22 as will be described further below.

Figure 2:
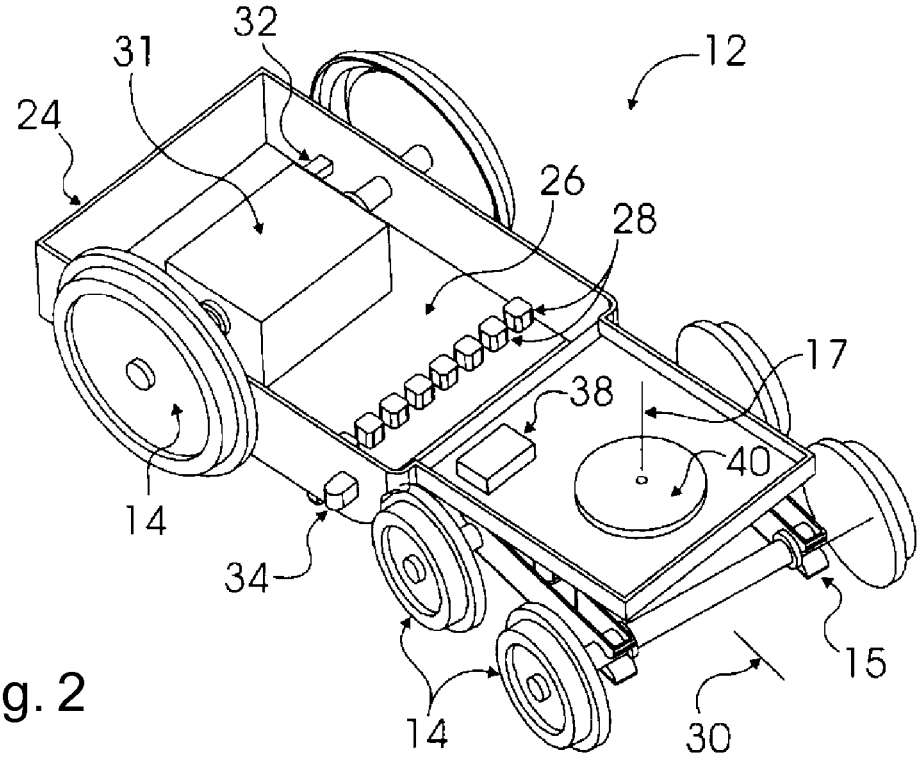
FIG. 2 is a view of the carriage of the train of FIG. 1 without the housing showing the engagement of wheels with a motor unit and showing a plurality of switch operators extending through the bottom of the carriage to be engaged by the note tiles.

Referring now also to FIG. 2, the train 12 rides upon a carriage 24 holding the wheels 14 for rotation and providing a bottom surface 26 which travels along the upper surface of track 18 above the actuator ridges 22 of the note tiles 20 when the train 12 moves therealong. Supported by the bottom surface 26 is a transverse array of nine switch operators 28. The operators 28 extend through the bottom surface of the bottom surface 26 to be pressed upward by actuator ridges 22 of different note tiles 20 when a note tile passes beneath an operator 28.

The front two pairs of wheels 14 are attached to a truck 15 that may swivel about vertical axis 17 to allow the train to navigate limited radius curves according to methods well known in the art. The rear wheels 14 are connected to a motor unit 31 such as may be battery powered electric motor or a spring motor or the like and which provides for automatic propulsion of the train 12 along the track 18. The motor unit 31 may include an actuator lever 32 controlling its speed and thus the speed that the train 12 passes along the track 18. As will be understood from the description that follows, the lever 32 may thus control the tempo of the played music.

Figure 3:
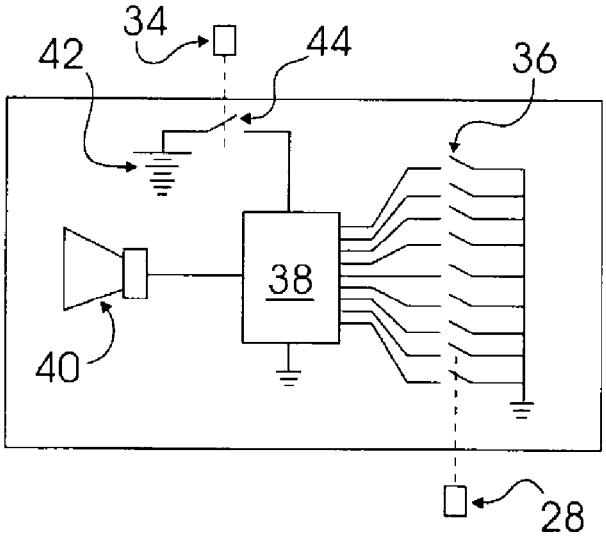
FIG. 3 is a schematic block diagram of the electrical circuitry actuated by the actuators of FIG. 2 to produce polyphonic music.

Referring now to FIGS. 2 and 3, each operator 28 may press one of a different bank of eight single pole, single throw switches 36 having one side connected to a ground connection and the other side connected to an input of a sound integrated circuit 38. Sound integrated circuit 38 connects to a speaker 40 and receives a power from a set of batteries 42 through the on/off switch 44 actuated by operator 34 extending from the side of the carriage 24 so as to be accessible when the train housing 13 is on the carriage 24.

It will be appreciated that the operators 28 need not be mechanical operators but may be, for example, proximity sensing operators, such as optical sensors, capacitive sensors, inductive sensors or the like for detecting the note tiles. For this purpose, the note tiles may be treated with a material to improve sensing, for example, retroreflective beads, paint, ferrite, magnets or the like.

As configured, one or more tones may be electrically generated by the sound integrated circuit 38 when particular ones of the switches 36 are pressed. Sound integrated circuits are commercially available from a number of suppliers.

Referring now to FIGS. 4*a* and 4*b*, each note tile 20 is a generally rectangular concave shell molded of a material such as a thermoplastic so as to be press fit into engagement with elements of the track 18 as will be described. The upper surface of the note tiles 20 include actuator ridges 22 extending longitudinally when the train 12 travels along the track 18.

Figure 7:
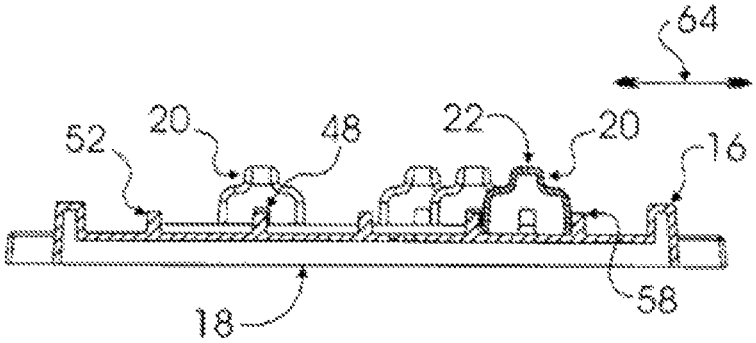
FIG. 7 is a cross-sectional view taken along line 7-7 of FIG. 1 showing engagement of the note tiles of FIGS. 4*a* and 4*b* with the track of FIG. 1 on note ridges or between note ridges by press fit.

Referring now also to FIGS. 6 and 7, the concave lower surface of the note tiles 20 include transverse stiffening ribs 46 and having centered notches 48 corresponding to centered notches 48 in longitudinally opposed end panels 50 of the note tiles 20. The notches 48 may engage one of five note ridges 52 extending longitudinally along the track 18 and spaced apart from other note ridges 52 in a transverse direction. Each note ridges 52 is an upwardly extending rail generally parallel to the rails 16 along which the train travels. The notches 48 may be wedge shaped so as to tightly engage against corresponding wedge shaped note ridges 52.

Figure 8:
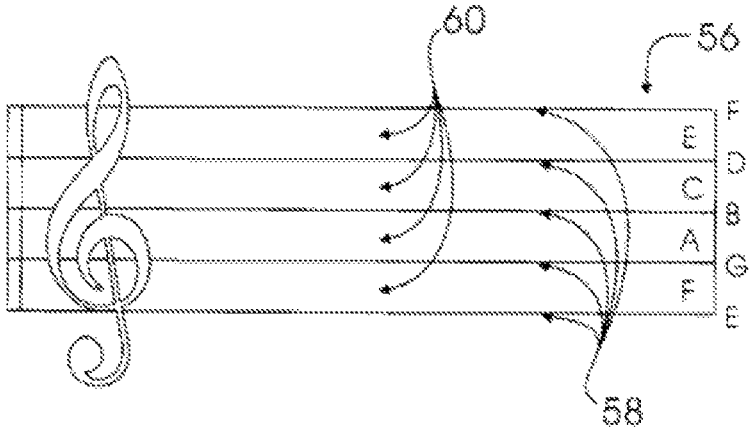
FIG. 8 is a graphic representation of a standard musical staff showing the notes corresponding to lines and spaces.
Figure 9:
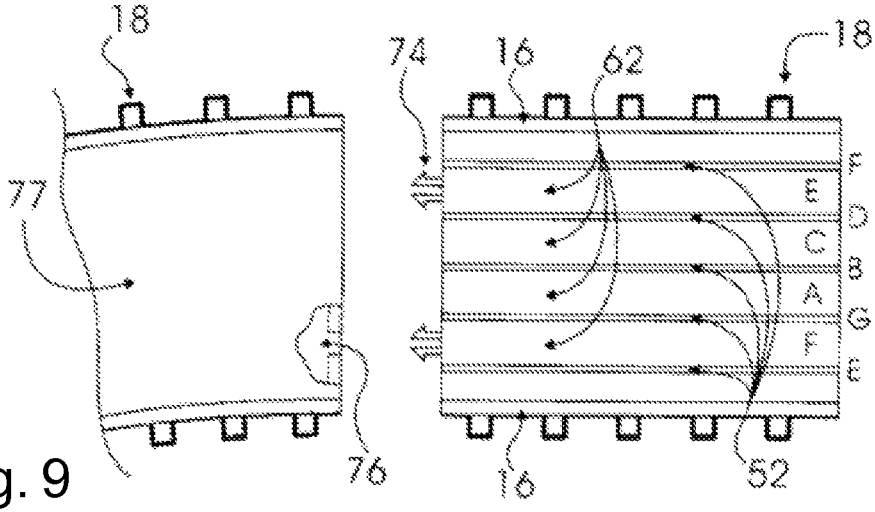
FIG. 9 is a plan view of the track of FIG. 1 showing the corresponding note ridges and spaces and their representative notes.

Referring now to FIG. 8, a conventional octave staff 56 is shown having five lines 58 and four spaces 60, the spaces corresponding to the letters F, A, C, E (in ascending order) and the lines corresponding to the notes E, G, B, D, F. Referring to FIG. 9, the five note ridges 52 correspond visually to the lines 58 of the stave and provide therebetween four channels 62 corresponding to the spaces 60 of the staff 56.

Referring now to FIG. 7, the notches 48 of the note tiles 20 may thus engage any one of the note ridges 52 allowing the note tiles 20 to be positioned along a pitch direction 64 in any one of five different locations corresponding generally to notes E, G, B, D, F. Alternatively, the note tiles 20 may be placed between the note ridges 52 in the channels 62 to be press fit with their opposed transverse walls engaged by adjacent note ridges 52 in any one of four locations corresponding generally to the notes F, A, C, E.

Referring again to FIG. 4*a*, for a note tile 20 representing an eighth note 67, its end panels 50 are separated by a unit distance L which, referring to FIG. 1, equals the separation of a set of transversely extending measure rails 66 and 68 crossing the note rails 52 on the upper surface of the track 18. The measure rails 66 and 68 represent a regular fraction of a measure such as a beat, allowing the eighth note tile 67 to fit at regular longitudinal locations between any two measure rails 66 and 68. Thus precision in rhythm may be enforced by means of the measure rails 68 and 66.

Referring to FIG. 4*b* for longer note tiles, for example, half note tile 70, having a separation of end panels 50 equal to 3 L, measure rail notches 72 are cut every L distance in the side panels so as to allow the note tile 70 to be placed also at regular intervals of L along the track but spanning several of the measure rails 68 and 66.

Rails 66 and 68 may be visually distinguishable either by shape or color as to provide an indication of the particular beat represented by the measure rails 68 and 66, for example, in 2/4 time. Alternatively, it will be understood that distinctions may be made between sets of four adjacent measure rails 68 and 66 to provide more metrical resolution. Further numbers or other indicia may be placed near these rails for guidance of the child.

Referring again to FIGS. 4 and 5, the longitudinal length of the note tiles 20 corresponds to the type of note represented. As shown in FIG. 5, four different note tiles 20*a* through 20*d* may correspond to four types of note from whole note 68*a* through eighth note 68*d*. Depending on the circuitry and configuration of the sound integrated circuit 38, the meaning of the different length of note tiles 20*a* through 20*d* may either be the separation of a played note from the next note, for example, as played on a piano, or the duration of the note, for example as played on an organ. It will be understood that the actuator ridge 22 thus need not be continuous but may be only an initial leading edge of the note tile 20. The symbol for the particular note 68*a* through 68*d* may be embossed or hot stamped on the surface of the note tiles 20*a* through 20*d*. The different note tiles 20 may also be given different colors to facilitate their selection by the child. The length of each note tile 20 is preferably an even integer multiple of the length of shorter note tiles 20 so as to correspond with standard musical convention.

Referring again to FIG. 9, track 18 is preferably fabricated sections, each section having at one longitudinal end attachment fingers 74 engaging corresponding attachment sockets 76 on the opposed longitudinal end of an adjacent track 18. Further, it will be recognized that curved track sections 77 may be produced allowing for loops of track to be created. Clearly other train-type track conventions may be blended with the musical capabilities of the present invention allowing, for example, switch sections and multiple loops. In looping configurations, multiple trains 12 may be placed on a track to provide for Rondo-type arrangements.

Current Improvement

Figure 10:
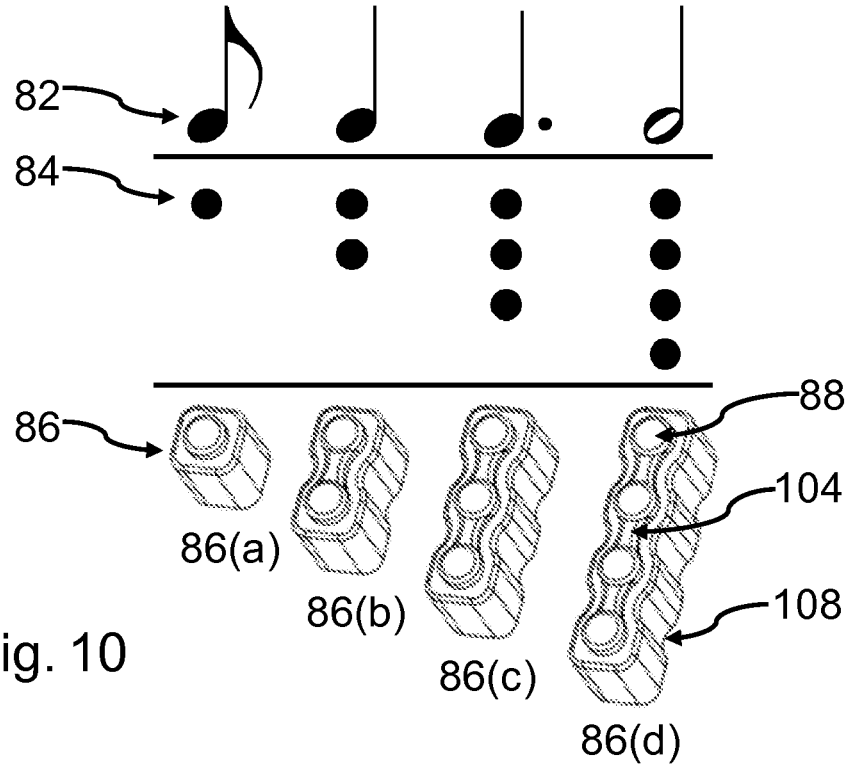
FIG. 10 is a pictorial representation of an alternative embodiment for the note blocks showing the beats for various notes used in standard musical notation and said note blocks having raised indicia that correspond to the beats for each type of note.

Referring now to another embodiment of the invention, the FIG. 10 note blocks 86(*a*) though 86(*d*) are shown in comparison to their corresponding musical notes 82. As previously described, each musical note 82 has a tone that is sustained for a prescribed duration of time. This duration is represented in FIG. 10 as the individual beats of musical time 84. Similarly, each note block 86 has a prescribed number of raised posts 88 that is equal to the number of beats 84 in its corresponding note type 82. For example, the last note block 86*d* has four beats 84 and represents a half note 82 as shown.

Figure 11A:
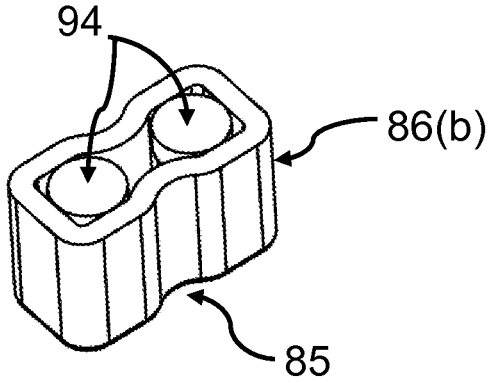
FIG. 11*a* is a view of the underside of the quarter note block of FIG. 10 with engaging studs shown in fragment for one embodiment of the internal socket structure that uses converging central arcs for securing the note block to the track of FIG. 12.
Figure 12:
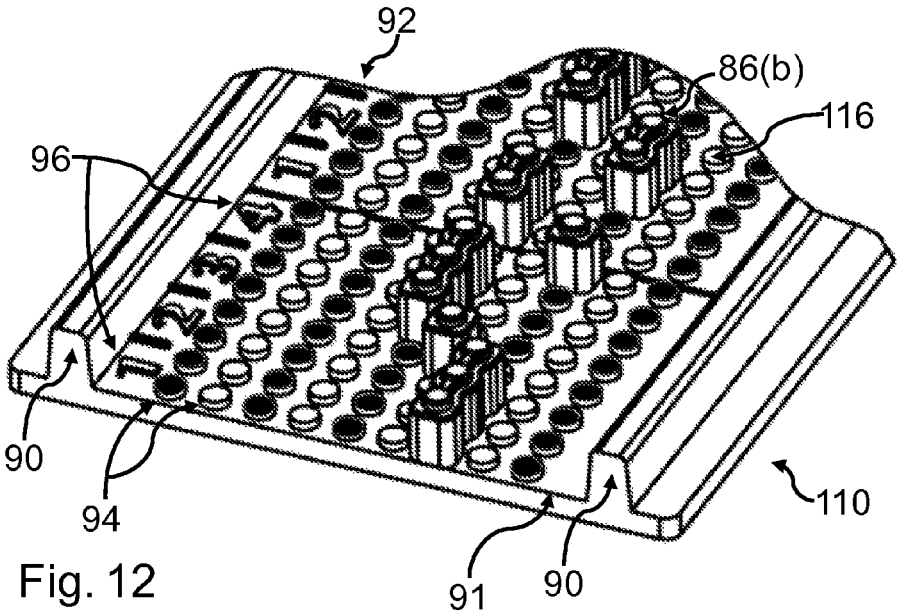
FIG. 12 is a perspective view of the toy of the preferred embodiment showing a track, the track providing posts of alternating black and white color as attachment means for the note blocks of FIG. 10 and having other indicia representing a standard musical staff of one octave and having various note blocks placed thereon.

Referring now to FIG. 11*a* there is shown the underside of a quarter note block 86*b*. The note block 86*b* made of plastic such as ABS has a thin walled shell design to receive the posts 94 from the track 110. Thus the note blocks can be securely connected to the track 110 of FIG. 12 with a press-fit condition between their inner shell and the outer wall of the posts 94. The thickness of the shell walls and the distance between the posts are designed in such a way that any two or more note blocks 86 can be placed adjacent to each other to play notes consecutively. Optionally, feature 85 of FIG. 11*a* shows the side walls of the note blocks as necked in between the posts to highlight the number of beats they represent.

Figure 11B:
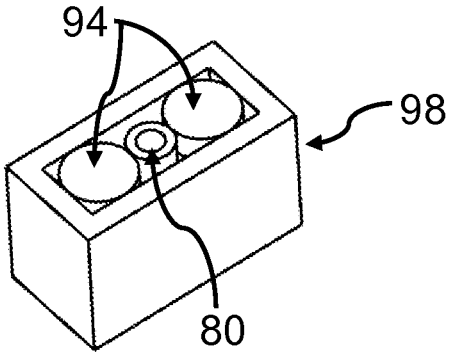
FIG. 11*b* is a view of the underside of an alternative embodiment of a quarter note block showing the internal structure that uses a central tube for securing the note block to the track of FIG. 12, also showing the studs in fragment as engaged to this socket structure.

The note blocks 86 may be configured to be compatible with the popular "Lego" brand of construction blocks and may be sized to use blocks from those collections. The mechanism of such blocks is described in detail, for example, in U.S. Pat. No. 3,005,282 hereby incorporated by reference. FIG. 11*b* shows the underside of a typical stud and tube block 85. The block shown is analogous to the quarter note block 86(*b*) of FIG. 10. The tube 80 protruding downward is press fit between the studs 94 of the note block 85. Stud-and-tube blocks are known to fit tightly to the posts in that type of system. This method could be employed in the present design if desired. However, because fast assembly and disassembly are desirable benefits of this invention, a lowered removal force could be achieved by making the posts 94 of the track 110 slightly smaller in diameter than typical Lego posts, while maintaining the other inner and outer wall dimensions of a typical Lego. In addition, it may be desirable to produce the blocks at a smaller scale than that of the Lego brand which could provide the benefit by minimizing cost and space considerations.

Referring again to FIG. 12 there is shown a track 110 with rails 90 between which are assembled the note blocks 86. The rails 90 provide guides for a vehicle that runs along the rails and over the note blocks 86. The rails 90 are generally trapezoidal and raised above the studs to allow for vertical space in which to place the note blocks 86. Similar to the aforementioned note tiles 20 of FIG. 7, the note blocks 86 are attached to the track 110 by locating them horizontally in the music measures 96 and vertically on one of a series of rows of alternating black and white posts 94. In this way the alternating rows of posts 94 on the track 110 represent a clear linear analog of the five black lines and four white spaces of a musical staff. Since plastic injection molding is most efficiently done in a single color of resin, a secondary paining operation would be required to apply the alternating rows of black and white color contrast. Tamping or rollers are means to applying the color, and the rows of raised posts are ideally suited for these methods of color application due to the separation of the post tops from one another and from other non-painted surfaces. Note that alternatively, the raised posts 94 could be recessed into the track and the note blocks might have protruding pegs as a connection means.

Figure 13:
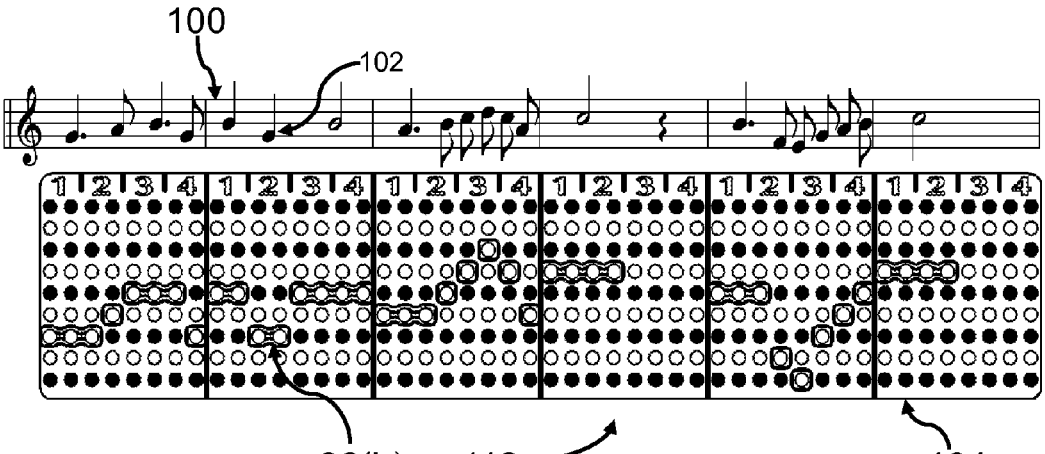
FIG. 13 is a view of a sample songbook page showing the relationship of the musical staff measures and notes to their corresponding placement on the track.
Figure 16:
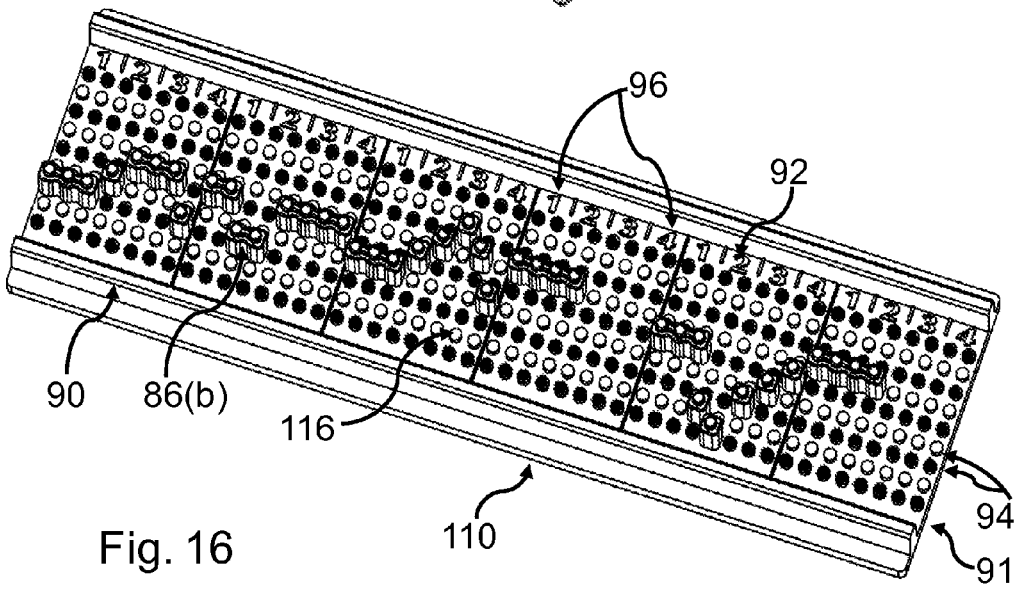
FIG. 16 is a full perspective view of the track segment shown in FIG. 12; the track consisting of six measures.

Now referring to FIG. 13, the songbook page 112 is a guide for placing the notes 86 onto the track 110. The musical staff 100 contains the arrangement of the color-coded notes 102 for a given song. Directly beneath the musical staff 100, the track segment 104 is shown on the songbook page 112 with the corresponding color-coded quarter note block 86(*b*) in line With the color-coded musical symbol for a quarter note 102. This provides a clear illustration of the relationship between the actual musical staff 100 and the note blocks on the track segment 104. In addition, the two posts on the note block 86(*b*) demonstrate to the user the association between the quarter note symbol 82 and two musical beats 84 as previously described in FIG. 10. Thus it is clear to the user that the quarter note 102 is related to the quarter note block 86(*b*) and covers two posts in length, or one quarter of the posts in a measure 96. Adding color to the notes and note blocks further reinforces this relationship for children and simplifies the task of proper placement. FIG. 16 is an isometric view of the track 110 showing the assembled notes that correspond to the six-measure segment of the songbook page 112 shown in FIG. 13.

Figure 14:
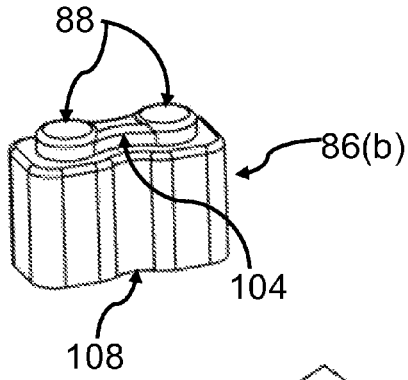
FIG. 14 is a perspective view of the quarter note block of FIG. 11*a* showing the bridge element between the two posts on the top surface as well as the recessed side surface.

Now referring to FIG. 14, a design using mechanical levers that engage the posts 88 of a note block 86 may require a bridge 104 between the posts 88 to keep the lever engaged for the full length of the note block. Thus the levers would be allowed to reset as they fell in the gap between the separate notes 86 of a given song. Now referring to FIG. 15, it may be desired to have a gap 126 between the posts 122 of the note blocks 98. In this way, the mechanical levers will fall between the posts 122 (or other operators would detect this) and modulate the output the tone for the note blocks 98, to provide a rhythmic beat, tremolo or vibrato.

Figure 15:
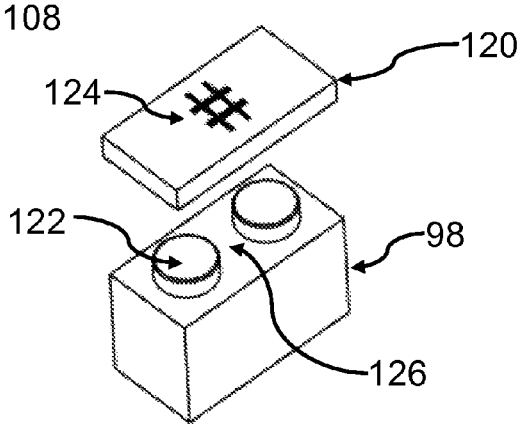
FIG. 15 is a perspective view of the quarter note block of FIG. 11*b* showing the upper posts that receive the capping plate and have a gap between the posts.

It may be useful to allow for each note 98 to be capable of sending a variety of electronic signals to the devise. As shown in FIG. 15, one means of accomplishing this is to include caps 120 for the note blocks 98 that would trigger a different signal to the system. The caps 120 might have a symbol 124 indicating the functional change associated with the presence of a capped note block on the track system. In this way the sound generator could be made to produce sharps and/or flats when the cap 120 is present. The cap feature 120 could also signal a shift to a higher or lower octave or perhaps play a chord or drum beat or different instrument when encountered on the track. It will be appreciated that different note tiles may be provided with integrated features 120 if desired. Alternatively, an extra row of posts could be placed in the space 91 adjacent to the post rows 94 (posts not shown). Blocks could be placed on this extra row of posts that would trigger functions similar to those of the aforementioned cap feature 120.

Generally then the invention can provide a musical toy that is a vehicle that rides down a track. Between the rails of the track are rows of alternating black and white colored posts that represent the musical staff or any number of lines of a musical scale. The posts are sized to receive note blocks that are placed in a sequence on the track by following the pattern of a song in the songbook. The note blocks are color-coded for the length of various note types. Each note block has a molded suggestion of the number of musical beats it represents. When a song is completed, a vehicle rides down the track and plays the music by means of switches under the carriage. This toy would allow for programming and then playing many songs. The track has a visual analog of the musical staff and music measures. The posts on the track match the posts on the color-coded note blocks to provide a visible indication of the numerical nature of musical time. Thus the toy would be an entertaining and useful musical teaching tool.

The above description has been that of a preferred embodiment of the present invention and it will occur to those that practice the art that many modifications may be made without departing from the spirit and scope of the invention. For example, the note tiles may be augmented with a percussion line using standard percussion notation as is understood in the art. In this case, the sound integrated circuit 38 is programmed to produce percussive effects in addition to or as an alternative to the notes described. It may be preferred to include more than the standard nine rows of a typical musical scale to allow for the incorporation of notes above and below a given scale for a given song. The present invention may be used with printed materials providing a visual indication of a setting up of the track and showing the correspondence between the notes and the tiles which differ primarily in the physical length of the tiles along axis 30. A number of different types of musical instruments may be employed including mechanical equivalents to the electronic device described herein. The music produced by the sound integrated circuit must be understood to include not only notes of a chromatic scale but optionally percussive and other sound with musical potential. It will be recognized that the mechanically actuated electrical switches described may be substituted by other sensing mechanisms including photodiodes detecting reflected light or magnetic or eddy current-type detection systems as are well known in the art. In order to apprise the public of the various embodiments that may fall within the scope of the invention, the following claims are made.

I claim:

1. A musical toy comprising:

(a) a vehicle having a carriage supported by wheels;

(b) a musical instrument having a plurality of transversely arrayed operators actuable to produce corresponding musical notes, the musical instrument held by the carriage of the vehicle to expose the operators therebelow;

(c) a plurality of note tiles having an upper surface for activating the operators and a lower surface having a first fastener half;

(d) a track having longitudinally extending guides so the vehicle may move along the track in a longitudinal direction as oriented by the guides, the track further having a plurality of second fastener halves to releasably receive the first fastener halves of the note tiles in engagement at different transverse locations so that the upper surface of the note tiles may actuate the operators of the musical instrument when the vehicle passes over the engaged note tiles;

wherein the second fastener halves comprise upwardly extending cylindrical studs arranged in rectilinear longitudinal rows and transverse columns and the first fastener half comprises a socket deforming to receive the cylindrical studs;

wherein a longitudinal outer extent of the note tiles provides a feature and wherein the operators sense the feature to modulate a note.

2. The musical toy of claim 1 wherein the note tiles have different longitudinal extent when placed on the track and wherein the longitudinal extent are even integer multiples of a note tile with shortest longitudinal extent.

3. The musical toy of claim 2 wherein the note tiles of equal longitudinal extent have a same color and of different longitudinal extent have a different color.

4. The musical toy of claim 2 wherein the note tiles have upwardly extending studs in proportion to a number of beats provided by the musical instrument when sensing the note tile.

5. The musical toy of claim 1 further including a printed diagram depicting the track and note tiles adjacent to a parallel musical staff and notes, where the note tiles are aligned with the notes and wherein the note tiles are arranged on the track to play a song depicted by the musical staff and notes.

6. The musical toy of claim 1 wherein the guides are upwardly extending longitudinal rails running along transversely separated edges of the track.

7. The musical toy of claim 1 wherein the rows of studs correspond in number to lines and spaces of a standard musical staff.

8. The musical toy of claim 7 wherein the number of rows of studs is nine.

9. The musical toy of claim 1 wherein alternate longitudinal rows of cylindrical studs are colored in a darker color than the intervening rows of longitudinal studs to depict staff lines and spaces.

10. A musical toy comprising:

(a) a vehicle having a carriage supported by wheels;

(b) a musical instrument having a plurality of transversely arrayed operators actuable to produce corresponding musical notes, the musical instrument held by the carriage of the vehicle to expose the operators therebelow;

(c) a plurality of note tiles having an upper surface for activating the operators and a lower surface having a first fastener half;

(d) a track having longitudinally extending guides so the vehicle may move along the track in a longitudinal direction as oriented by the guides, the track further having a plurality of second fastener halves to releasably receive the first fastener halves of the note tiles in engagement at different transverse locations so that the upper surface of the note tiles may actuate the operators of the musical instrument when the vehicle passes over the engaged note tiles;

wherein the second fastener halves comprise upwardly extending cylindrical studs arranged in rectilinear longitudinal rows and transverse columns and the first fastener half comprises a socket deforming to receive the cylindrical studs;

further including capping elements having a lower surface releasably attaching to an upper surface of the note tiles having an upper surface for activating the operators to change a note played by the musical instrument with respect to that played by the note tile without the capping element.

11. The musical toy of claim 10 wherein the capping element on the note tile causes a musical instrument to play a sharp or flat relative to the note tile without the capping element.

12. The musical toy of claim 10 wherein the capping element on the note tile causes and musical instrument to play a different instrument sound relative to the note tile without the capping element.

13. The musical toy of claim 10 wherein the note tile causes the musical instrument to play a different octave relative to the note tile without the capping element.

14. A musical toy comprising:

(a) a vehicle having a carriage supported by wheels;

(b) a musical instrument having a plurality of transversely arrayed operators actuable to produce corresponding musical notes, the musical instrument held by the carriage of the vehicle to expose the operators therebelow;

(c) a plurality of note tiles having an upper surface for activating the operators and a lower surface having a first fastener half;

(d) a track having longitudinally extending guides so the vehicle may move along the track in a longitudinal direction as oriented by the guides, the track further having a plurality of second fastener halves to releasably receive the first fastener halves of the note tiles in engagement at different transverse locations so that the upper surface of the note tiles may actuate the operators of the musical instrument when the vehicle passes over the engaged note tiles;

wherein the second fastener halves comprise upwardly extending cylindrical studs arranged in rectilinear longitudinal rows and transverse columns and the first fastener half comprises a socket deforming to receive the cylindrical studs;

further including modified note tiles having an upper surface for activating the operators to change a note played by the musical instrument with respect to that played by the note tile without modification.

* * * * *